US005620091A

United States Patent [19]

Larson

[11] Patent Number: 5,620,091

[45] Date of Patent: Apr. 15, 1997

[54] GOLF BAG CLUB HOLDER

[76] Inventor: Gordon E. Larson, 10828 Spyglass Dr., Rancho Cucamonga, Calif. 91730

[21] Appl. No.: 128,118

[22] Filed: Sep. 29, 1993

[51] Int. Cl.[6] ..... A63B 55/00

[52] U.S. Cl. ..... 206/315.6; 206/315.3

[58] Field of Search ..... 206/315.6, 315.3, 206/315.2

[56] References Cited

U.S. PATENT DOCUMENTS

| | | | |
|---|---|---|---|
| 1,849,610 | 3/1932 | Boyce | 206/315.6 |
| 2,436,687 | 2/1948 | Corbett | 206/315.6 |
| 3,331,419 | 7/1967 | Bencriscutto | 206/315.6 |
| 3,503,518 | 3/1970 | Black | 206/315.6 X |
| 3,667,078 | 6/1972 | Distasto | 206/315.6 X |
| 4,194,547 | 3/1980 | Sidor et al. | 206/315.6 |
| 4,200,131 | 4/1980 | Chitwood et al. | 206/315.6 |
| 4,208,227 | 6/1980 | Cowan | 206/315.6 |
| 5,094,345 | 3/1992 | Yonnetti | 206/315.6 X |
| 5,135,107 | 8/1992 | Ingraham | 206/315.6 |
| 5,228,566 | 7/1993 | Shenoha | 206/315.6 |
| 5,383,555 | 1/1995 | Weinmeier | 206/315.6 |

*Primary Examiner*—Sue A. Weaver
*Attorney, Agent, or Firm*—Baker & Daniels

[57] ABSTRACT

The object of this invention is to provide golf club holder which will prevent individual clubs from striking each other, or falling out of the bag under either golf play or transportation conditions. A basic club head holder is disclosed in this invention in which uniquely shaped apertures hold the club heads in place. These apertures contain an angled slot opening and a cantilevered top protrusion which partially closes the aperture top opening. Insertion and removal of the club requires only alignment of the club blade with the slot entrance. During insertion, the top protrusion is laterally bent by the club head until the blade is seated, then it bends back to captivate or "hook" the hosel. Since the cantilever is stiffer against rotation away from the bag, the clubs are prevented from falling out. The inside edges of the aperture may be covered with a grommet-like cushioning material in order to further protect the club heads. In alternate embodiments, the holding assembly can be made in separate segments which may be connected together. These designs serve to both reduce the shipping package size and provide a size adjustment upon assembly so as to fit various bags of different diameter. In one arrangement, the separate sections are joined at the edges by a unique set of rectangular notches which dovetail together and partially overlap. One end notch and mating protrusion is made circular in order to provide an interlock against horizontal separating forces.

6 Claims, 7 Drawing Sheets

GOLF BAG CLUB HOLDER

BACKGROUND OF THE INVENTION

1. Technical Field

This invention relates generally to apparatus for holding golf clubs in a controlled alignment within a golf club carrier such as conventional golf bag. More particularly, the invention improves upon those devices which 2. Background Art Numerous devices for maintaining alignment of golf clubs within a golf bag have been proposed. Early art described various golf bag partitioning means, wherein one or more golf clubs are separated from one another in at least one dimension. Lateral partition strips have been used to divide the opening plane of a bag, and vertical tubing arrangements have extended shaft protection down to the bag's closed end. More recent improvements have addressed the provision of more complete protection under the many environments under which a set of golf clubs may be subjected.

In U.S. Pat. No. 3,503,518 for instance, Black combines lateral shaft holding notches with inclined individual club blade fitted groves which hold each club head so as to prevent rotational contact. Distasio, in U.S. Pat. No. 3,667,078, discloses a club holder which clips on the outside of the bag. Vertically adjustable head receptacles provide cover and maintain the club heads disposed inwardly. Sidor et al, in U.S. Pat. No. 4,194,547, holds the club in a more permanent non-sliding arrangement by using shaft tubes which contain a lower end split-tube clip which grips the club handle. Upper end club heads rest on V-notched peripheral and cross bag racks which maintain the club heads outward. Cowen wraps his club holder around the outside of the bag top in U.S. Pat. No. 4,208,227, and places the club heads under single edge holding compression. The holder is a resilient collar containing club head holding open notches which increase their grip when the collar is bent around the bag and tightened with a belt wrapping. With the club shafts within the bag, the club heads are disposed outwardly.

Placement of club heads outward is the preferred arrangement when playing, since the club head numbers may be more easily read. All of the above approaches which present the iron heads in this outboard manner however, expose the heads to scraping when the bag contacts the ground, and to extra handling damage during transportation.

During play, bags cannot always be maintained with their top end above horizontal. This is especially true when they are carried down hill by means by shoulder strap or cart, or are placed open-end downward on an inclined surface. It is desirable therefore, to provide restraint against clubs sliding longitudily out of the bag.

DISCLOSURE OF INVENTION

With the foregoing drawbacks of the prior art in mind, it is an object of the present invention to provide club holding means which will prevent individual clubs from striking each other under both golf play or transportation conditions. In brief, this is accomplished by restraining each club against both lateral translation and rotational movement toward neighboring clubs, as well as longitudinally against gravity.

A basic club head holder is disclosed in this invention in which uniquely shaped apertures hold the club heads in place. These apertures contain an angled slot opening and a cantilevered top protrusion which partially closes the aperture top opening. Insertion and removal of the club requires only alignment of the club blade with the slot entrance. During insertion, the top protrusion is laterally bent by the club head until the blade is seated, then it bends back to captivate or "hook" the hosel. Since the cantilever is stiffer against rotation away from the bag, the clubs are prevented from falling out.

The inside edges of the aperture may be covered with a grommet-like cushioning material in order to further protect the club heads.

In alternate embodiments, the holding assembly can be made in separate segments which may be connected together. These designs serve to both reduce the shipping package size and provide a size adjustment upon assembly so as to fit various bags of different diameter.

In one arrangement, the separate sections are joined at the edges by a unique set of rectangular notches which dovetail together and partially overlap. One end notch and mating protrusion is made circular in order to provide a rotational interlock after engaging, the notches on adjacent segments.

It is another object of the invention to prevent clubs from falling out of a non-upright bag by further restraining the longitudinal motion of the clubs along an axis parallel to centerline of the golf bag, yet still provide easy low-force removal of the club for playing purposes.

It is yet another object of the invention to provide club head support means which will ease installation of a golf bag cover by permitting translation motion of the club heads radially inward toward the centerline of the bag.

Still another object of the invention is to provide a club holder which may be inexpensively manufactured, simply installed, structurally rigid and safe, and which will add negligible weight to the total bag assembly.

The above and other objects, features and advantages of the present invention will become more apparent from the following description when making reference to the detailed description and to the accompanying sheets of drawings in which preferred structural embodiments incorporating the principals of this invention are shown.

BRIEF DESCRIPTION OF THE DRAWINGS

The details of my invention will be described in connection with the accompanying drawings, in which.

BEST MODE FOR CARRYING OUT THE INVENTION

Figure 1:
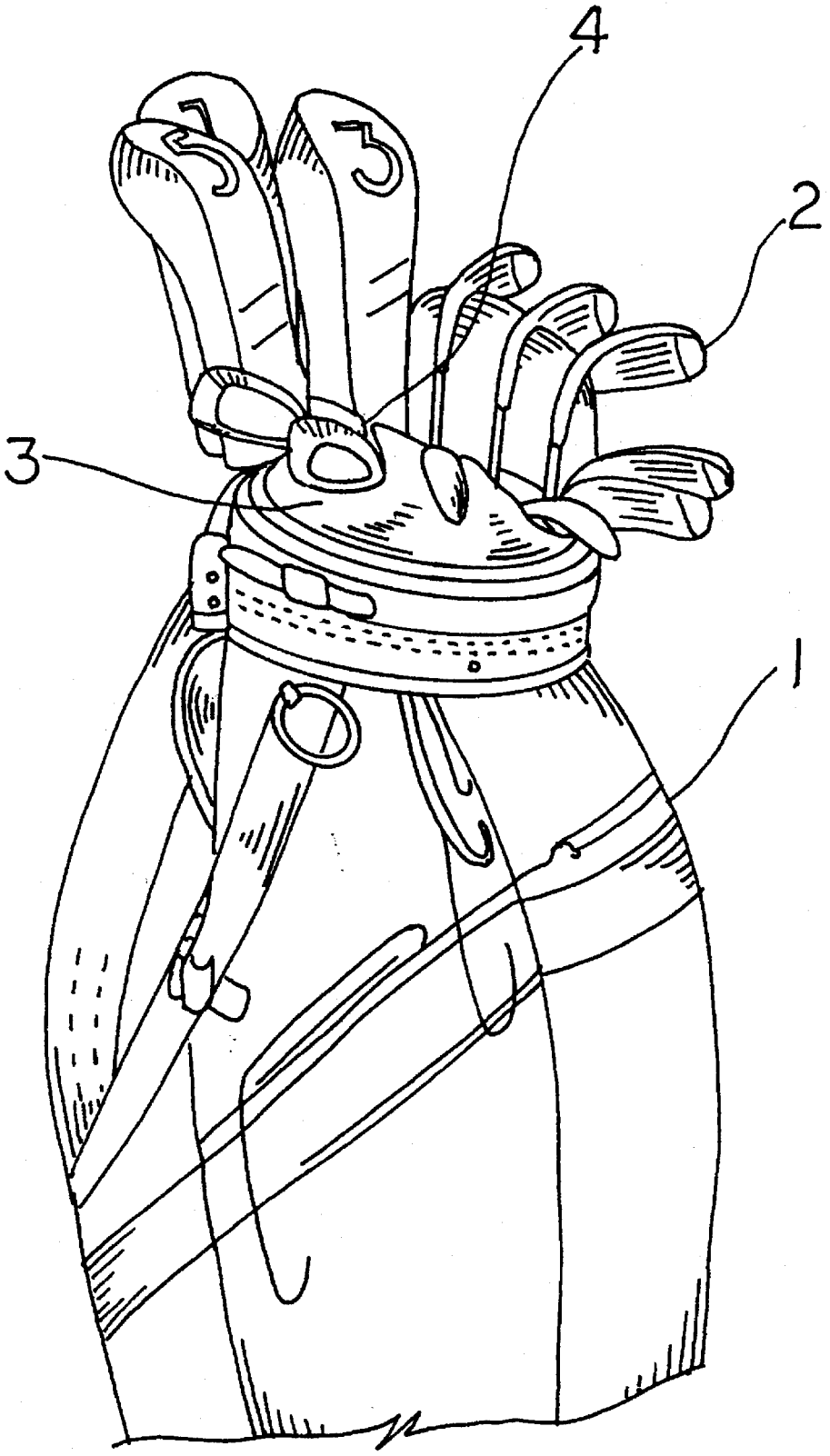
FIG. 1 is a perspective view of the top end of a golf bag containing a number of clubs supported by the holder of this invention.

Certain preferred embodiments of the present invention are described herein in greater detail with reference to the accompanying drawings, in which like reference characters designate like or corresponding parts throughout the several views.

Figure 2:
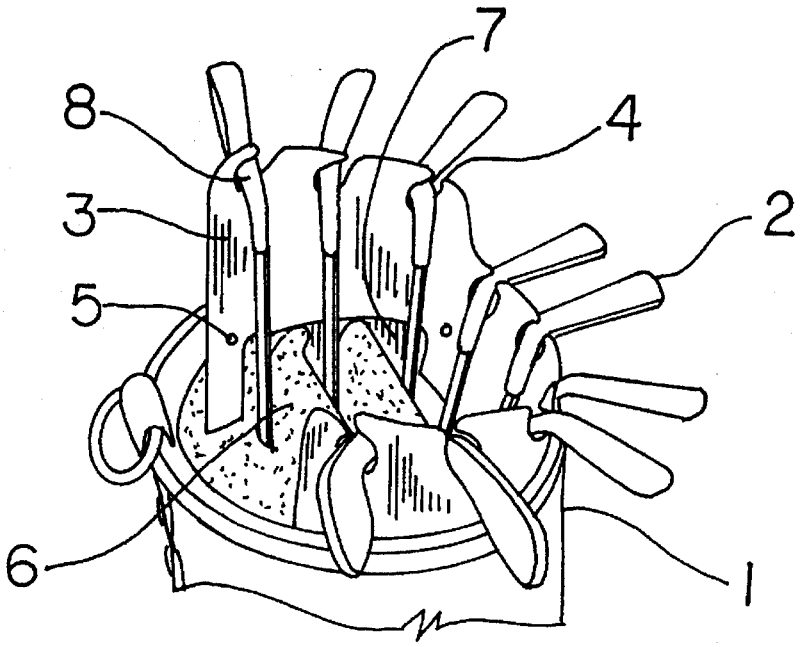
FIG. 2 is an expanded isometric view of the bag opening of FIG. 1, showing the iron clubs and holder in greater detail.

FIG. 1 shows a view of the top portion of an upright typical golf bag I with a plurality of clubs being supported by the preferred club holding embodiment of this invention. The supporting structure 3 contains golf club holding slotted apertures 4 with club heads 2 in place, and is attached to golf bag 1. Referring to expanded view FIG. 2, the support structure 3 is attached to bag 1 by common attachment means such as mechanical fasteners 5, bonding processes, and/or removable clips. The bottom edge portion of structure 3 has cut out regions 7 in order to clear bag sectional struts 6 which are typically arranged to provide rectilinear row and column bag bracing and division of multiple club groupings. The top edge portion of said structure 3 can be tapered so as to provide a height variation which will maintain an approximately constant height of the bottom end of each club from the bag 1 floor. As shown in FIG. 2, the structure heights are arranged in three groups. Each group holds three irons, with the two outside groups having average heights associated with the first three numbered irons and the second three numbered irons respectively. The top edge portion of said two outside groups have a piece wise continuous taper so as to place the forth through sixth club heads on the same downward slope as that of the first three club heads. The third group is centered in the bag between the other two groups and is used to accommodate the shortest clubs in the bag. Since the variation in height of the clubs in this group is minimum, the top edge of this section is shown to be fiat, i.e. horizontal when installed in a vertical bag.

Figure 2A:
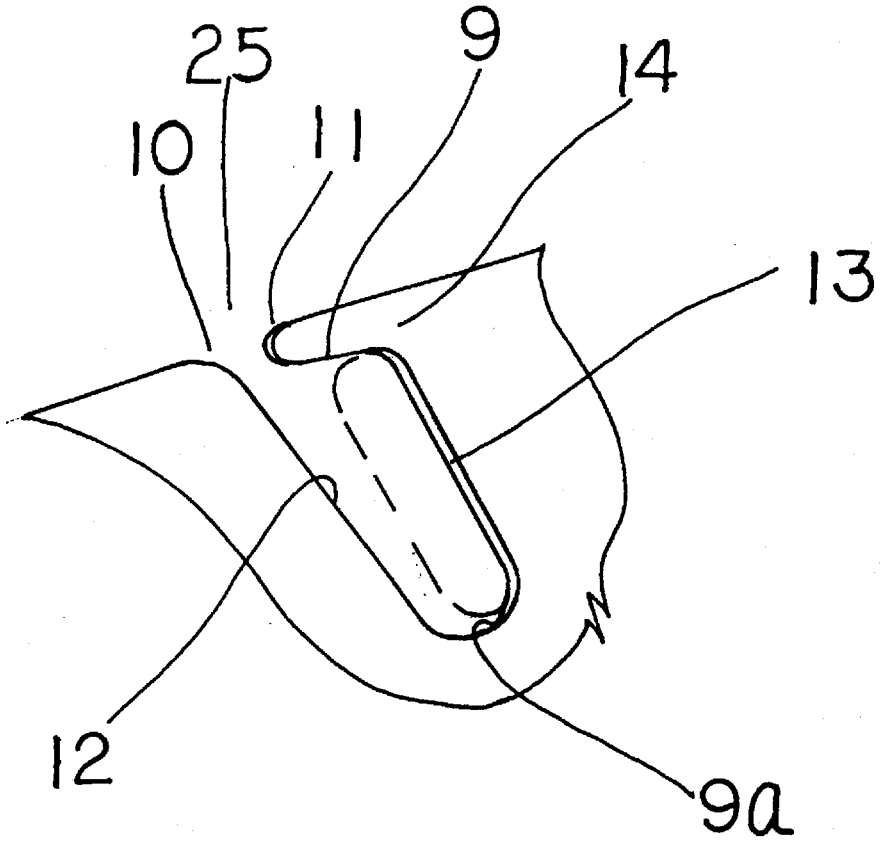
FIG. 2*a* a side view of a typical slotted opening cut in the side of the holder of FIG. 2.

It will be noted that the peripheral distance of the three sections-three clubs arrangement does not extend around the total circumference of the bag top opening. It is obvious that more than the nine iron clubs shown in FIG. 2 can be supported. Thus a higher grouping along the top side of the bag could support woods, with their normal protective covers, or a wider short grouping could support special ancillary irons such as chippers or sand wedges up front. Golf club heads 2 are usually connected to their shafts by curved means called "hosels" 8. Each club head face is inclined out of the plane containing the shaft by an angle which increases with the number assigned to the iron. In FIG. 2, slots 4 are cut out along the top edge of support 3 in order to support individual clubs 2 in their hosel region 8. Slots 4 are angled off vertical so as to conform to the average incline of the above groups of club heads, or may be individually angled to that associated with each particular supported club. Details of the shape of the slotted opening are shown in FIG. 2*a*. Bottom 9A and top 9 ends of the slot are arcuate with the latter having a narrowed top opening 10 cut out for club insertion and removal. Angled slot sides 12 and 13 may be cut parallel in an ovate form, or relatively angled as in FIG. 2*a*. A first straight side 12 is cut from the top edge of support 3 to the arcuate bottom 9A. The second angled side 13 does not extend to the top edge, thereby leaving a tapered protrusion 11 partially across the top of the slot. In FIG. 2*a*, the relative angulation results in the width of the bottom 9A of the slot being greater than that at the top 9 of the slot so as to accommodate a downward tapered club hosel 8.

The side of narrowed top opening 10 is an extension of side 12 of the slot with the result that protrusion 11 extends beyond the top centerline 25 of the slot. Protrusion 11 thus serves as a flexible tab to captivate or "hook" the club from the top, thereby restricting vertical club motion. Protrusive tab 11 is in effect cantilevered across the top opening 9, however, the vertical thickness at the root 14 is greater than the horizontal thickness of support 3 at the protrusion end 11. Cantilever bending therefor easily occurs about a longitudinal axis parallel to the bag axis, but motion is more stiffly constrained in the orthogonal plane about a radial axis lying in the plane of the top bag opening. Club insertion is thus accomplished by moving the club head outwardly and downwardly against protrusion 11 until it bends and allows the club hosel to pass through the increased opening. Once through, the protrusion snaps back to the captivating position. Removal is accomplished by an upward and inward motion to release the constraint by bending the protrusive tab 11.

Figure 3:
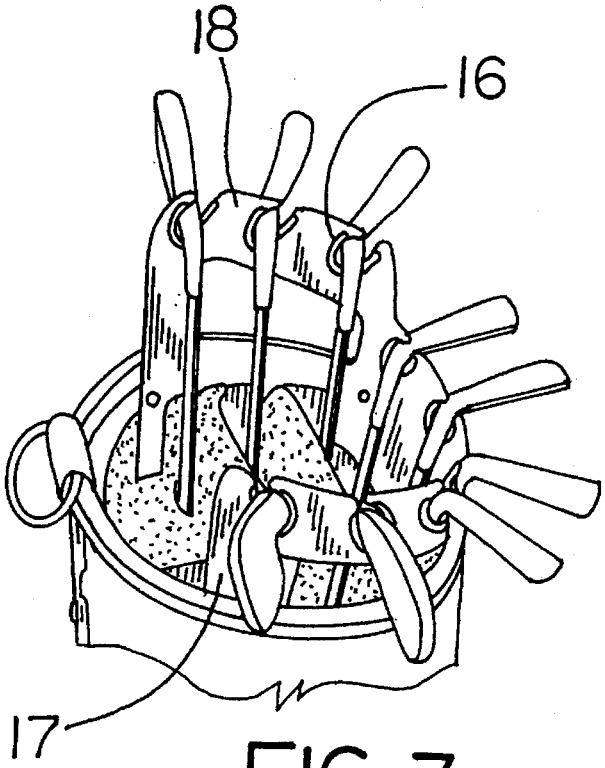
FIG. 3 is a perspective view of an alternate holder with a cushion insert in each aperture.

FIG. 3 shows an alternate slot design with club cushioning material installed at each club position. Each slot has a cushion insert 16 that locks into place. The cushion is in form of a 0.250 inches outer diameter tube with a 0.100" diameter hole in the center. The tube is slotted from One end to the other at the bottom with a deeper slot near the center. The end to end slot is 0.094 inches wide (thickness of the material) to a depth of ½ the distance from the surface of the tube to the 0.1" center hole. The center notch depth is through to the hole in the center. Two cushion captive areas are used—one in the front of the opening and one in the back, with the back area being slightly smaller. These captive areas have a cut out for the slotted sections of the cushion and an upper and lower square pin (not shown) which is placed inside the cushion center hole. The bottom is placed in the cushion slot that is cut through to the center hole.

When the cushion 16 is installed in the slot, it is placed inside the cushion center slot on the lower front pin. The upper end of the cushion is then flexed to engage the front hook upper pin, then pressed into place. All cushions can be removed/replaced using the reverse assembly process.

These cushions provide additional protection for the irons and also virtually eliminate sounds with club removal/insertion as well as noise during travel in the golf cart or when walking and carrying the golf bag.

In the above embodiment, the invention can be manufactured in one or more subassemblies from a plastic such as Kydex. The unit can have notches for from 8 to 10 irons at the appropriate positions and elevations, while providing connections to the golf bag. Different sizes can be used to fit bag diameters from 8 to 10½ inches, or expansion means, such as overlapping or pleated arrangements may be devised. Fabrication of fixed sizes may be by means of die stamping, followed by thermal forming into the appropriate diameter. Alternate fabrication methods include injection molding in multiple parts to cover the bag sizes and club counts required. In one embodiment, separate side units may be connected at the center to provide for a minimum of notches. Expansion may be obtained by separating the front center portion and inserting a variable slotted extension piece.

FIG. 3 depicts an alternate embodiment in which a single design fits various bag sizes from 8" to 10½." This configuration is made up of four sections and a strap to lock the sections in place inside the golf bag. The four sections include a left 17 and right side panel 18 and two center sections 19, 20, which are identical. The left side panel (viewed from the front) organizes four irons, typically the 9, 8, 7, and 6 iron. The right side panel organizes an additional four irons, typically the 3, 4, and 5 irons and pitching wedge. The two center sections organize one additional club each, typically the 9 iron and a wedge. The sections may be assembled in the following alternate ways.

A. Two Side Panels

When the two side panels are assembled together without the two center sections, the panels will hold 8 iron sections. This configuration, with the strap, is compatible with golf bag from 8" to 9" (OD). The circular length is 19¼.

B. Two Side Panels and One Center Section

When one center section is placed between the two side panels the design will support and organize nine irons. This configuration, with the strap, is compatible with golf bags from 8½ to 9½" (OD). The circular length is 19¼".

C. Both Center Sections Between Two Side Panels

When both center sections are used between the two side panels the club holder will organize ten irons. This configuration with strap is compatible with golf bags from 9" to 10" (OD). The circular length is 21½.

Figure 4:
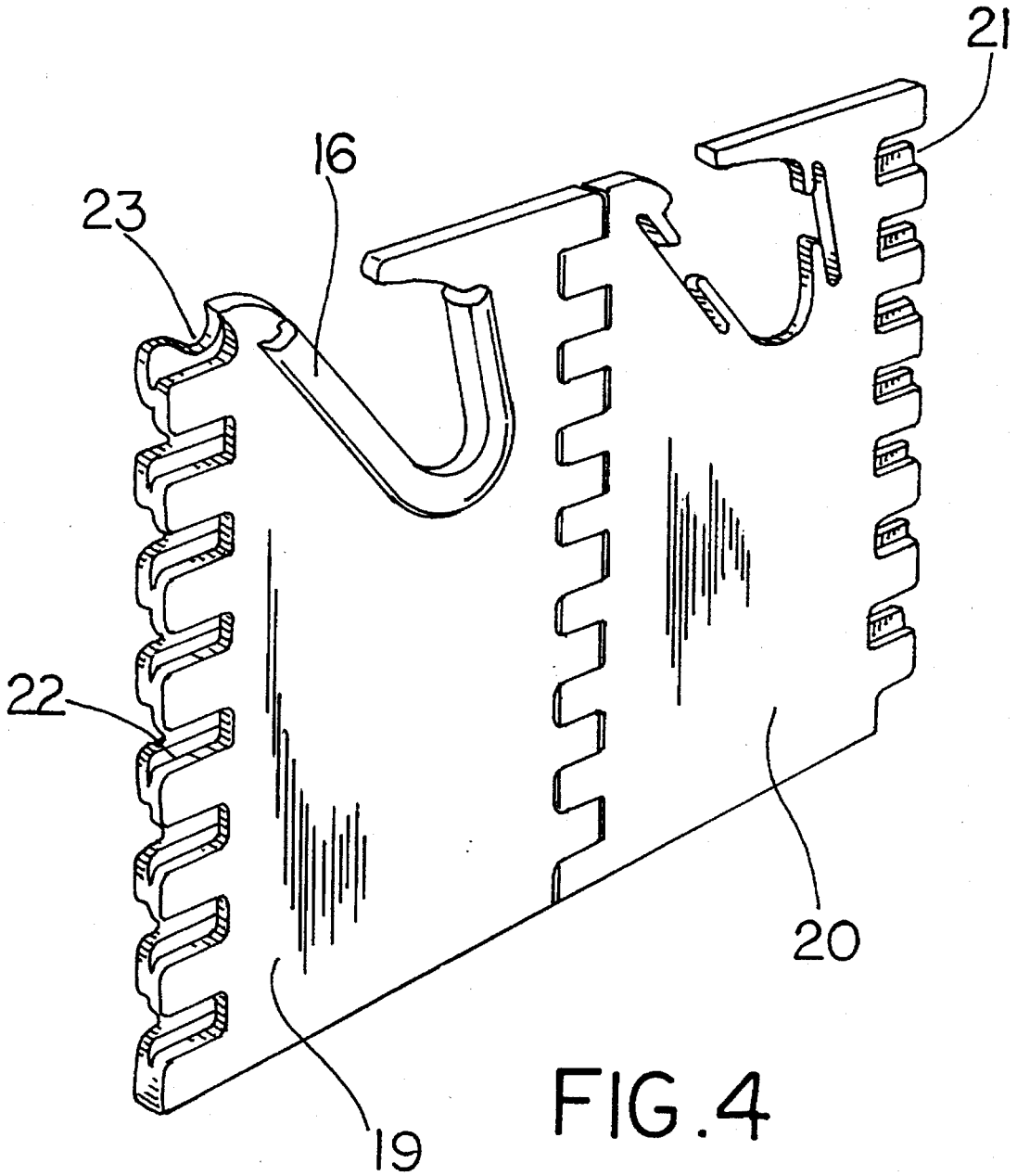
FIG. 4 is a perspective view of a pair of joined center sections used in a segmented holder.

FIG. 4 shows a perspective view of a pair of center panels 19, 20 joined together. Matching notches are embedded along the edges of both side panels and on both sides of each center sections. There are two sets of notches 21 on each mating edge. An inner row of notches 29, and an outer row of notches 22 are off set from each other by ½ notch width. Each row is embedded to ½ material thickness.

The left side mating edge, outer and inner row of notches is off set from the right side mating edge by one notch width. When plugged together, the end edges of the are thus aligned because of this off set. The notches then prevent longitudinal slippage of the mating sections. Since the inner and outer notches are off set by ½ notch width, an overlapping joint is formed which will prevent radial bending. Engaging and disengaging to mating sections is accomplished by aligning the mating sections at an end while pressing together. When mated, the joint between the two curved portions resembles an interlocked jigsawed puzzle piece. Although only one such joint is shown at the upper end of FIG. 4, multiple interlocking joints may be used.

The matching sections have an additional feature which prevents the assembled sections from separating during handling and assembly in the golf bag. The upper notch 23 has a curved protrusion on one side of the mating edge and a similarly curved mating aperture on the other side of the mating edge. Also, the lower notches on the inner row have a small circular interlock arrangement with 0.010 interference which is over come by pressure (not shown). Joining two sections is accomplished by engaging the bottom, pressuring the interlock and snapping the upper interlock together. Separation is achieved by pressuring the lower interlock apart and rolling the upper interlock apart. This feature locks the mating sections together so that they will remain joined until they are intentionally separated as often as required during the process of installation. Once installed the sections cannot be separated until the assembly is removed from the golf bag.

Many conventional ways of fitting and attaching the holder to variable sized bags are possible. Separate compression straps can be used to maintain the circumferential positioning of the holder, while mechanical fasteners provide radial attachment to the bag.

The strap is placed in the strap recess in the side panel on one side and across/over the strap recess on the other side panel. With the club holder and strap pressed tightly in place, the distance between the strap recess ends, is marked. The strap is placed in the strap recess on both sides, with the strap inward to the golf bag center. This is the weak holding setting. The strap can now be adjusted in rotation but will remain where it is released. The strap can now be partially set and the golf clubs placed a positions to assure that the height is correct. Finally, the strap can be fully set against the golf bag. In the fully set position the strap has been compressed by about ½" placing the assembly under pressure against the surface of the golf bag.

The assembly can further secured by mechanical fasteners that just penetrate the golf bag inner surface in order to further prevent movement under severe handling conditions. It should be also noted that when the club holder is installed, the sections are under further pressure forcing the mating sections together circumferentially.

Figure 5:
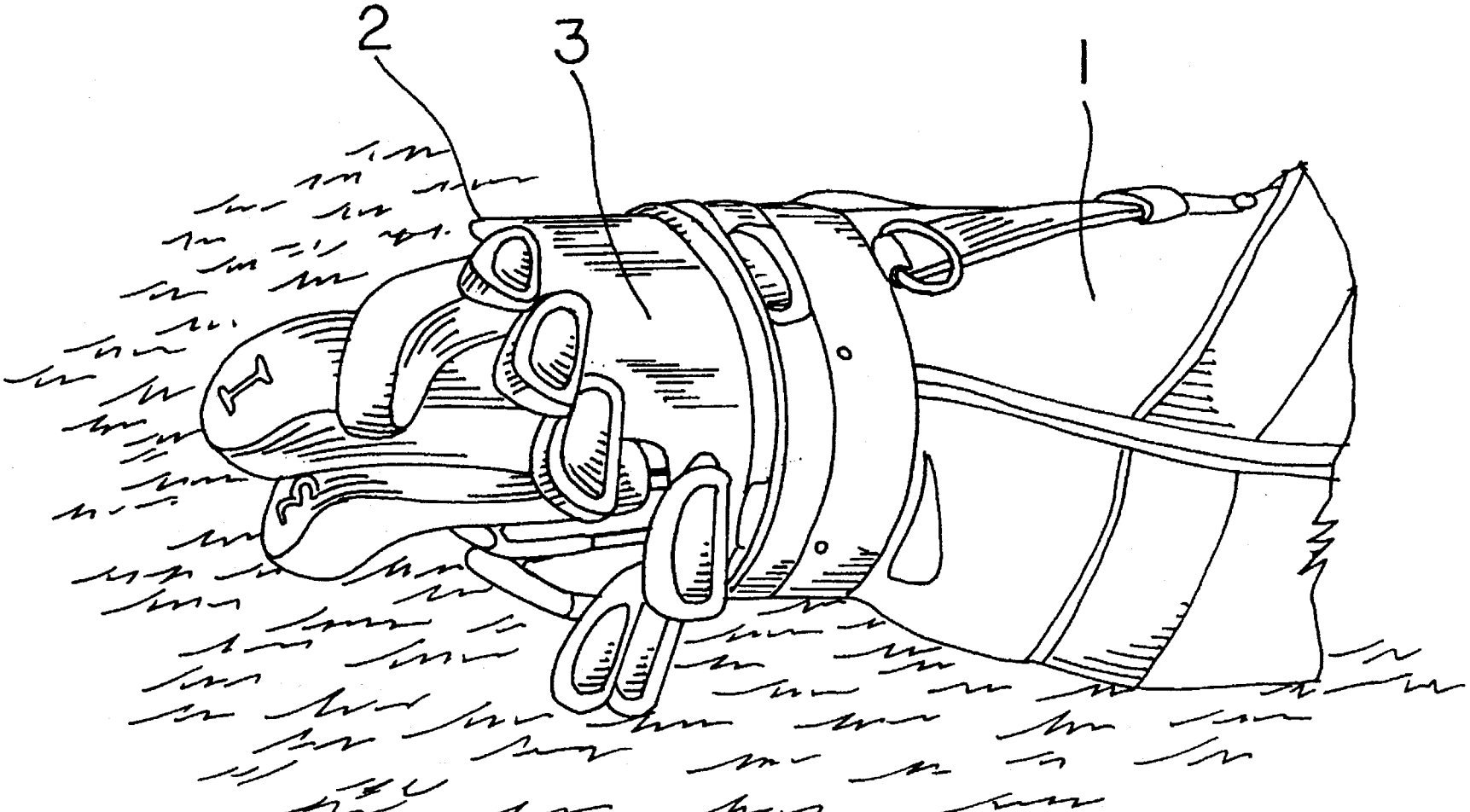
FIG. 5 is a side view of the FIG. 1 bag lying on the grassy ground of a golf course.

FIG. 5 depicts a bag laying on the ground. It will be noted that the clubs stay in place and do not fall on top of each other. The material protruding from the bag is flexible, allowing the clubs to rotate and flex upwardly to conform with the outer perimeter of the golf bag. If the bag is further rotated to a downhill slope position, the clubs remain in place because the stiffened cantilevered tab will not bend in the orthogonal direction under low G gravitational forces. Indeed, picking up the bag upside down in the dark, and placing it on an airplane baggage exit ramp, should not cause the clubs to fall out. Of course, when traveling on an airplane, the clubs are further restrained by use of the bag cover, and by placing cushioning material such as a towel or sweater within the cover.

Figure 6:
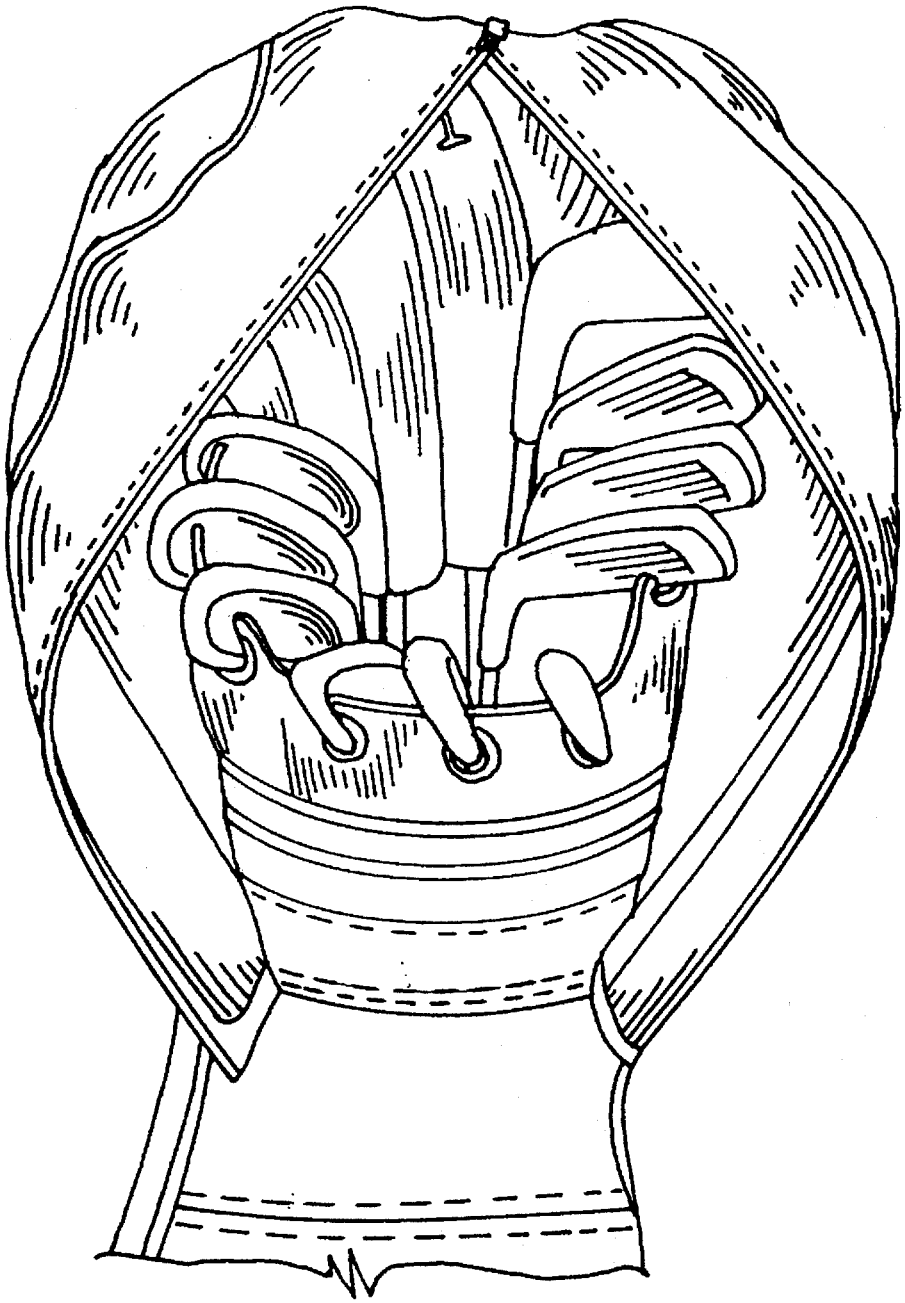
FIG. 6 is a perspective of the FIG. 1 bag with an unzipped club cover in place over a set of cavity backed irons.
Figure 7:
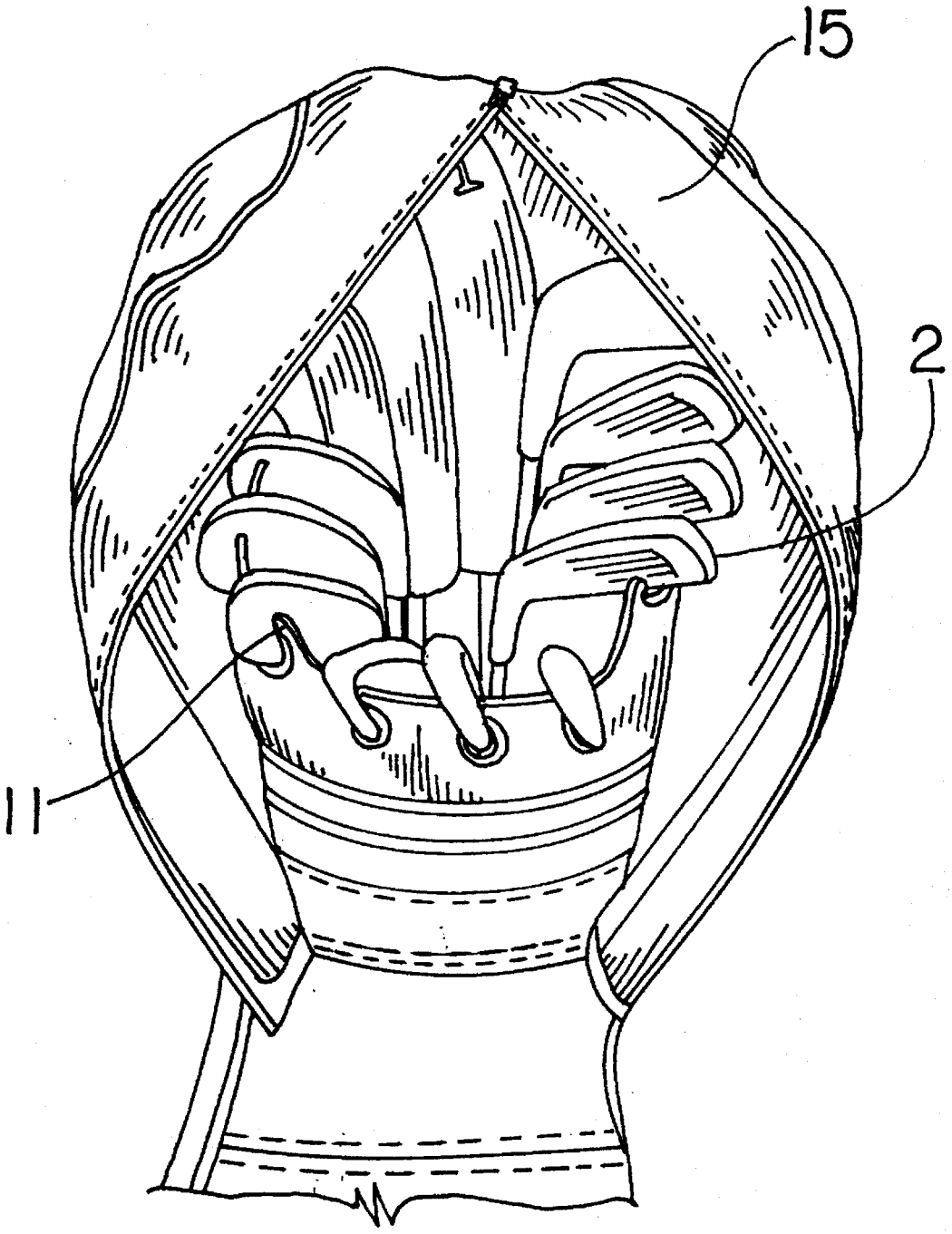
FIG. 7 is another perspective of the FIG. 1 bag with an unzipped club cover in place over a set of non-cavity backed irons.

The average slot width is made sufficient to permit movement of the clubhead radially inward toward the center longitudinal axis of the bag 1. If the club head is lifted slightly upward when so moved, tab 11 will bend and bear upon the side of the clubhead 2. This feature is especially useful when the bag cover is placed over the bag prior to travel. FIG. 7 shows the club heads 2 pushed back with tab 11 in bending spring contact the side of the club head prior to zipping up the cover 15. The overall club-tip diameter of the bag plus clubs is now reduced to as to allow the cover to be closed. In a usual situation, the club heads are turned inward where striking between adjacent clubs is enhanced. With this invention the club heads retain their relative relationship and are further restrained during travel by the spring tension of the cantilevered tab. If cavity-backed iron clubs are used as in FIG. 6, the tab rides within the cavity and further limits clubhead motion. Although the present invention has been described in considerable detail with reference to certain preferred versions thereof, other versions are possible. Therefore, the spirit and scope of the appended claims should not necessarily be limited to the description of any preferred versions contained herein.

I claim:

1. Apparatus for holding golf clubs in a bag, comprising:

golf club holding means extending outwardly from the open end of a golf bag, said means having side, top and bottom edge portions, said top edge portion of said holding means having a plurality of spaced apart side apertures, said side apertures including notches angulated in accordance with the pitch of each of the club heads, each said side aperture having a top opening for receiving heads of golf clubs, each of said side apertures further being resiliently lined to cushion club contact therein;

top restraining means over each said side aperture for restricting vertical club head motion, said top restraining means including a first protrusion flexibly cantilevered in a single plane approximately parallel to the plane of a said side aperture so as to define a top entrance opening over each said aperture through which a golf club head may be laterally pushed, wherein each said first protrusions are integrally formed over the top opening of each said side aperture, each said first protrusion further being stiffly cantilevered in a vertical plane approximately parallel to the longitudinal axis of the golf bag, and wherein said first protrusions continuously bear upon the outside surfaces of the club heads when the club heads are moved radially inwardly toward the centerline of the golf bag opening, so as to enable a golf bag cover to be placed over all clubs in the bag, whereby each golf club may be axially restrained from falling out of the golf bag when the bag is turned over; and means for attaching said golf club holding means to the open end of the golf bag.

2. Apparatus for holding golf clubs in a bag, comprising:

golf club holding means extending outwardly from the open end of a golf bag, said means having side, top and bottom edge portions, said bottom edge portion of said golf club holding means having clearance apertures formed thereon whereby said golf club holding means may be inserted around any golf club dividing struts positioned near the opening of the golf bag, said top edge portion of said holding means having a plurality of spaced apart side apertures, each said side aperture having a top opening for receiving heads of golf clubs, said top edge portion further being vertically staggered so as to suspend the grip end of a golf club or a selected group of golf clubs a desired distance from the bottom of the golf bag, said golf club holding means being circumferentially segmented into a plurality of interconnected side panel portions, each said side panel portion having inside and outside surfaces and side interconnection means and being coextensive with said vertically staggered segments;

top restraining means over each said side aperture for restricting vertical club head motion, said top restraining means including a first protrusion flexibly cantilevered in a single plane approximately parallel to the plane of the golf bag opening, each said first protrusion partially covering the top opening of a said side aperture so as to define a top entrance opening over each said aperture through which a golf club head may be laterally pushed, each said first protrusion further being stiffly cantilevered in a vertical plane approximately parallel to the longitudinal axis of the golf club bag, whereby each golf club may be axially restrained from falling out of the golf bag when the bag is turned over; and means for attaching said golf club holding means to the open end of the golf bag.

3. The apparatus of claim 2, wherein said side interconnection means comprises:

horizontal second protrusions staggered along each edge of said side portions in a vertical row;

horizontal apertures spaced between said second protrusions and aligned with protrusions of an adjacent edge of an interconnected side panel portion so that each of the second protrusions is connected with each horizontal aperture of the adjacent edge.

4. The apparatus of claim 3, wherein each said second protrusion has a radial horizontal thickness equal to approximately one-half the radial horizontal thickness of said side panel portions in order to produce a vertical row of half-thick second protrusions.

5. The apparatus of claim 4, wherein the inside portions of the vertical row of half-thick second protrusions are vertically shifted a distance approximately equal to one-half of the height of their mating horizontal apertures relative to the outside portions of the vertical row of half-thick second protrusions so that when said inside and outside surfaces of said half-thick protrusions are mated with their corresponding horizontal apertures, said inside and outside portions of said half-thick protrusions will partially overlap each other.

6. The apparatus of claim 5, wherein at least one said second protrusion and its mating horizontal aperture has a curved portion on their surface plane cross-section so as to interlock said protrusion and aperture against horizontal circumferential separation.

* * * * *